US009334705B1

(12) United States Patent
Ward et al.

(10) Patent No.: US 9,334,705 B1
(45) Date of Patent: May 10, 2016

(54) SUBSEA CONNECTOR

(71) Applicant: OneSubsea IP UK Limited, London (GB)

(72) Inventors: Scott D. Ward, Houston, TX (US); Christopher Kocurek, Houston, TX (US); Daniel McLaughlin, Houston, TX (US)

(73) Assignee: OneSubsea IP UK Limited, London, England (GB)

( * ) Notice: Subject to any disclaimer, the term of this patent is extended or adjusted under 35 U.S.C. 154(b) by 0 days.

(21) Appl. No.: 14/595,950

(22) Filed: Jan. 13, 2015

(51) Int. Cl.

| | |
|---|---|
| ***E21B 17/01*** | (2006.01) |
| ***E21B 33/038*** | (2006.01) |
| ***E21B 33/064*** | (2006.01) |
| ***E21B 19/00*** | (2006.01) |

(52) U.S. Cl.
CPC ..... *E21B 33/038* (2013.01); *E21B 17/01* (2013.01); *E21B 19/002* (2013.01); *E21B 33/064* (2013.01)

(58) Field of Classification Search
CPC ..... E21B 17/085; E21B 33/038
USPC ..... 166/344, 349, 360, 368
See application file for complete search history.

(56) References Cited

U.S. PATENT DOCUMENTS

| | | | | |
|---|---|---|---|---|
| 3,321,217 | A * | 5/1967 | Ahlstone | 285/18 |
| 3,325,190 | A * | 6/1967 | Eckert et al. | 285/18 |
| 6,035,938 | A * | 3/2000 | Watkins | 166/345 |
| 6,138,762 | A * | 10/2000 | Sweeney et al. | 166/359 |
| 7,503,391 | B2 * | 3/2009 | McCanna et al. | 166/343 |
| 8,474,537 | B2 * | 7/2013 | Voss et al. | 166/338 |
| 8,485,267 | B2 * | 7/2013 | Nguyen et al. | 166/378 |
| 9,062,513 | B2 * | 6/2015 | Pallini et al. | |
| 2005/0001427 | A1 * | 1/2005 | Liew | 285/322 |
| 2015/0114659 | A1 * | 4/2015 | Jahnke | 166/360 |

* cited by examiner

*Primary Examiner* — Matthew R Buck
(74) *Attorney, Agent, or Firm* — Chamberlain Hrdlicka

(57) ABSTRACT

A subsea connector for connecting an upper subsea component to a lower subsea component of a drilling, production, or completion system. The subsea connector includes locking members configured to move radially inward to engage the upper and lower subsea components in a locked position, and radially outward to return to an unlocked position. The locking members are hydraulically or mechanically actuatable. The subsea connector particularly may include a locking member such as a dog or collet connector disposed in the subsea connector to lower the bending moment of the system, thereby increasing the bending capacity of the system.

24 Claims, 5 Drawing Sheets

SUBSEA CONNECTOR

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates to the field of connectors for connecting subsea components. More particularly, the present disclosure relates to a subsea connector that attaches to the outer profile of a subsea component such as a wellhead and increases the bending capacity, lowers the bending resistance, and/or provides a supportive load path for, a subsea drilling, production, or completion system.

Wellhead connectors typically comprise upper and lower portions, wherein the upper portion is coupled to a subsea component by being screwed, bolted or affixed by other means to the upper portion. The lower portion typically has a cylindrical profile that extends around the wellhead housing. The upper portion has a shoulder that lands on the upper rim of the wellhead. A seal can be disposed at the shoulder between the wellhead and the upper portion of the wellhead connector.

A locking member, such as a set of dogs or collet fingers, is moved from a radially retracted position, wherein the locking member is not in contact with the wellhead, to a radially engaged position, wherein the locking member is in contact with the outer profile of the wellhead. Moving the locking member into the retracted position allows the wellhead connector to be removed from the wellhead, together with a subsea component coupled to the wellhead connector. Moving the locking member into the engaged position secures the subsea component coupled to the wellhead connector to the wellhead.

When the wellhead connector is in the engaged position, the system experiences bending loads from movement of the system above the wellhead. The limits of operation for a subsea system are determined by the bending capacity of the system. The bending capacity can be translated into a diameter extending from the wellhead knowing as a "watch circle." As total system bending capacity increases, the watch circle can be increased. Increasing the watch circle improves the safety of the system, increasing the operational window and improving system efficiency. In particular, increasing bending capacity allows for additional remediation time prior to execution of emergency procedures required to mitigate high loading situations (e.g., drive-off, emergency disconnect, shear-and-seal, etc.).

BRIEF DESCRIPTION OF THE DRAWINGS

Embodiments of the disclosed subsea connector are described with reference to the accompanying figures. The same numbers are used throughout the figures to reference like features and components throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but, would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
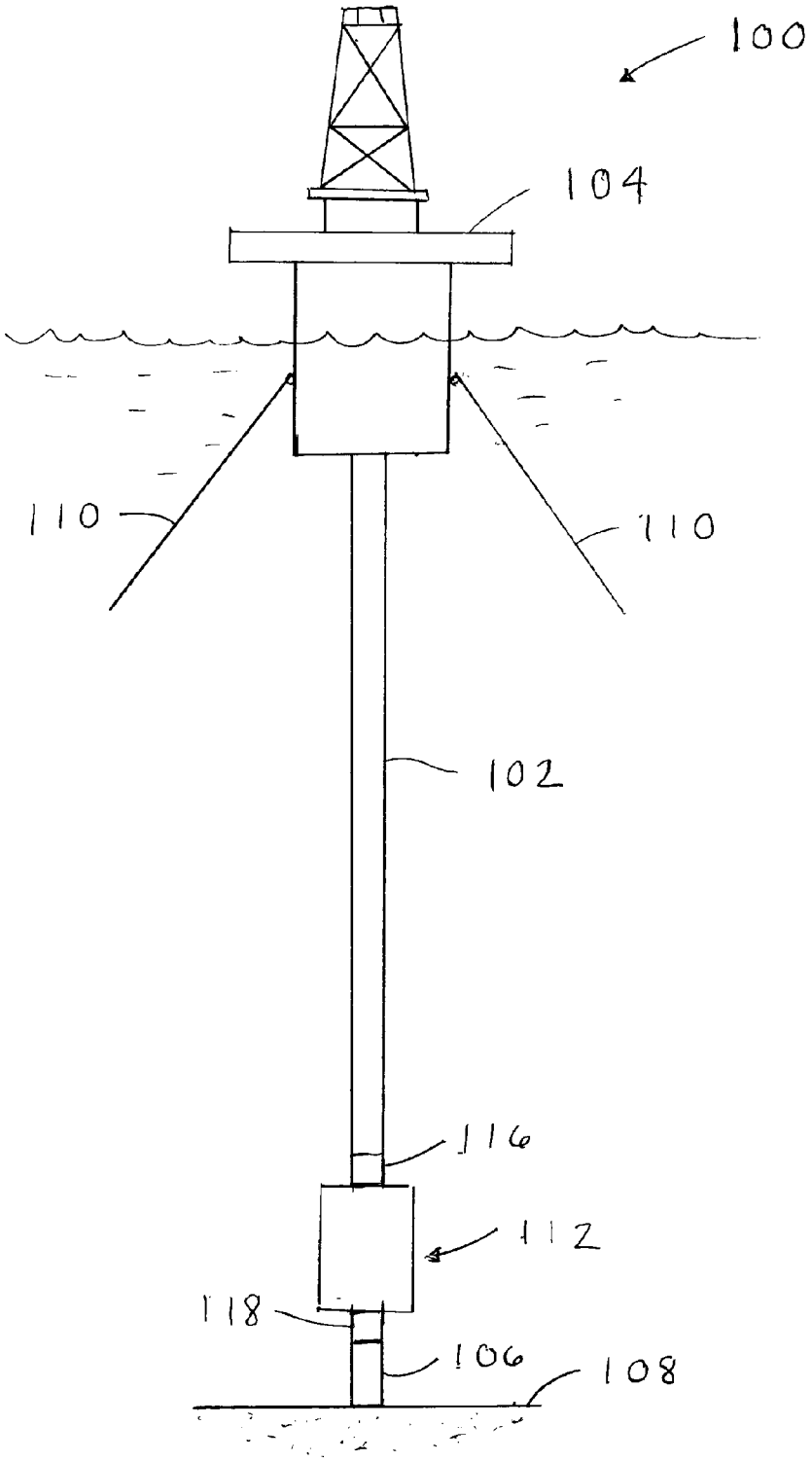
FIG. 1 is a schematic view of an example system in which embodiments of the disclosed subsea connector can be implemented.

Referring now to FIG. 1, a schematic view of an offshore system 100 is shown in which the disclosed subsea connector can be used. In this example, the system 100 is an offshore production system. The system 100 includes a riser 102 extending between a floating platform 104 and a subsea wellhead 106 located on the sea floor 108. Because the example shown is a production system, the riser is designed as a production riser string. However, it should be appreciated that the offshore system 100 and the riser 102 may also be designed and configured for drilling and completion operations in accordance with different embodiments.

In the example shown in FIG. 1, the platform 104 is a SPAR-type platform. The system 100 includes mooring lines 110 to attach the floating platform 104 to the sea floor. Other types of floating structures can be used with the disclosed subsea connector, including floating production storage and offloading (FPSO) systems, semi-submersible platforms, tension leg platforms (TLPs), and others known to those of ordinary skill in the art.

Figure 2:
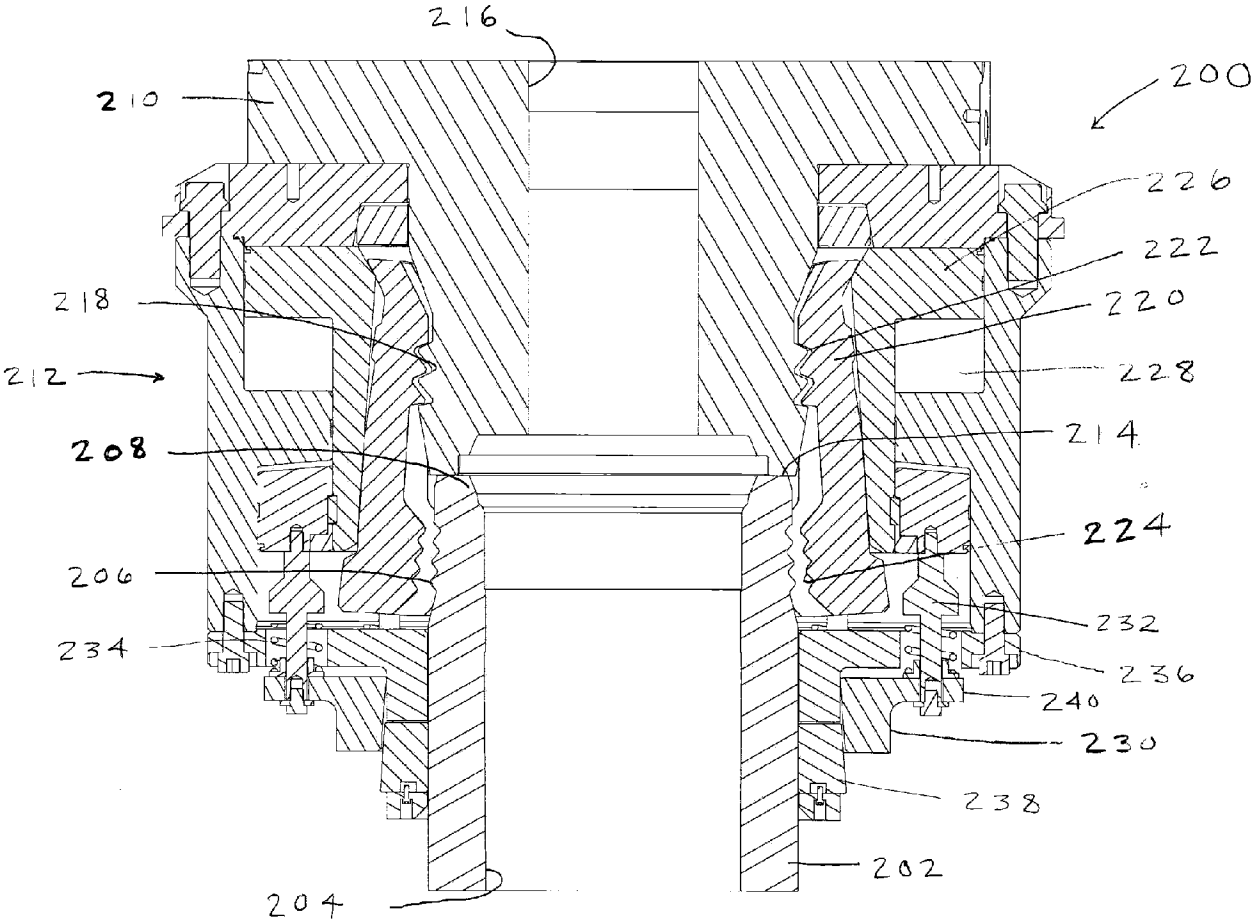
FIG. 2 is cross sectional elevation view of a collet style subsea connector assembly according to one embodiment of the present disclosure in an unlocked position.

The connection between the subsea wellhead 106 and the platform 104 provided by the riser 102 allows fluid communication therebetween. The riser 102 includes a subsea tree 112 at its lower end proximate the wellhead 106. The subsea tree 112 can be of any type for controlling pressure in the system 100, for example, vertical or horizontal, production or injection, monobore or multi-bore. A riser connector 116 connects the top of the subsea tree 112 to the riser string. A subsea connector 118 connects the bottom of the subsea tree 112 to the wellhead 106. The bending capacity of the subsea connector 118 impacts the operational capacity of the system 100. Referring to FIG. 2, an embodiment of a collet style subsea connector assembly 200 according to the present disclosure is shown. The locking members of this disclosure may include collet fingers, as in this embodiment, or wedges or tapers, dogs, slip segments, or other latching devices in other embodiments. Similarly, the load support members of this disclosure may include dogs, wedges, segments, or the like. In oilfield parlance, a dog is a radially energized load and/or lock member. The collet style connector assembly embodiments of this disclosure may be hydraulically operated and may also include a manual override feature. The dog style connector assembly embodiments of this disclosure may be either hydraulically or manually operated.

Wellhead member 202 is located on a sea floor and secured to a string of conductor pipe (not shown). The wellhead and conductor pipe form the foundation of the well system. Wellhead member 202 is generally cylindrical and includes an axial bore 204 and grooves 206 on the outer profile of the wellhead member 202. The grooved profile 206 includes downward-facing grooves. Wellhead member 202 includes a rim 208 including a chamfered edge on its internal profile.

The subsea connector assembly 212 is configured to couple spool member 210 to wellhead member 202. Spool member 210 can be any subsea production, drilling, or completion component, including, but not limited to, a subsea tree, tree system spool, blowout preventer, riser, or the like. Spool member 210 includes a landing shoulder 214 with a downward facing surface. Rim 208 of wellhead member 202 has a corresponding upward facing surface upon which landing shoulder 212 lands. A seal (not shown) may be disposed about the outer diameter of the internal bore 204 and between landing shoulder 212 and rim 208. Spool member 210 is generally cylindrical and includes an axial bore 216 and grooves 218 on the outer profile of the spool member 210. The grooved profile 218 includes downward-facing grooves.

Figure 3:
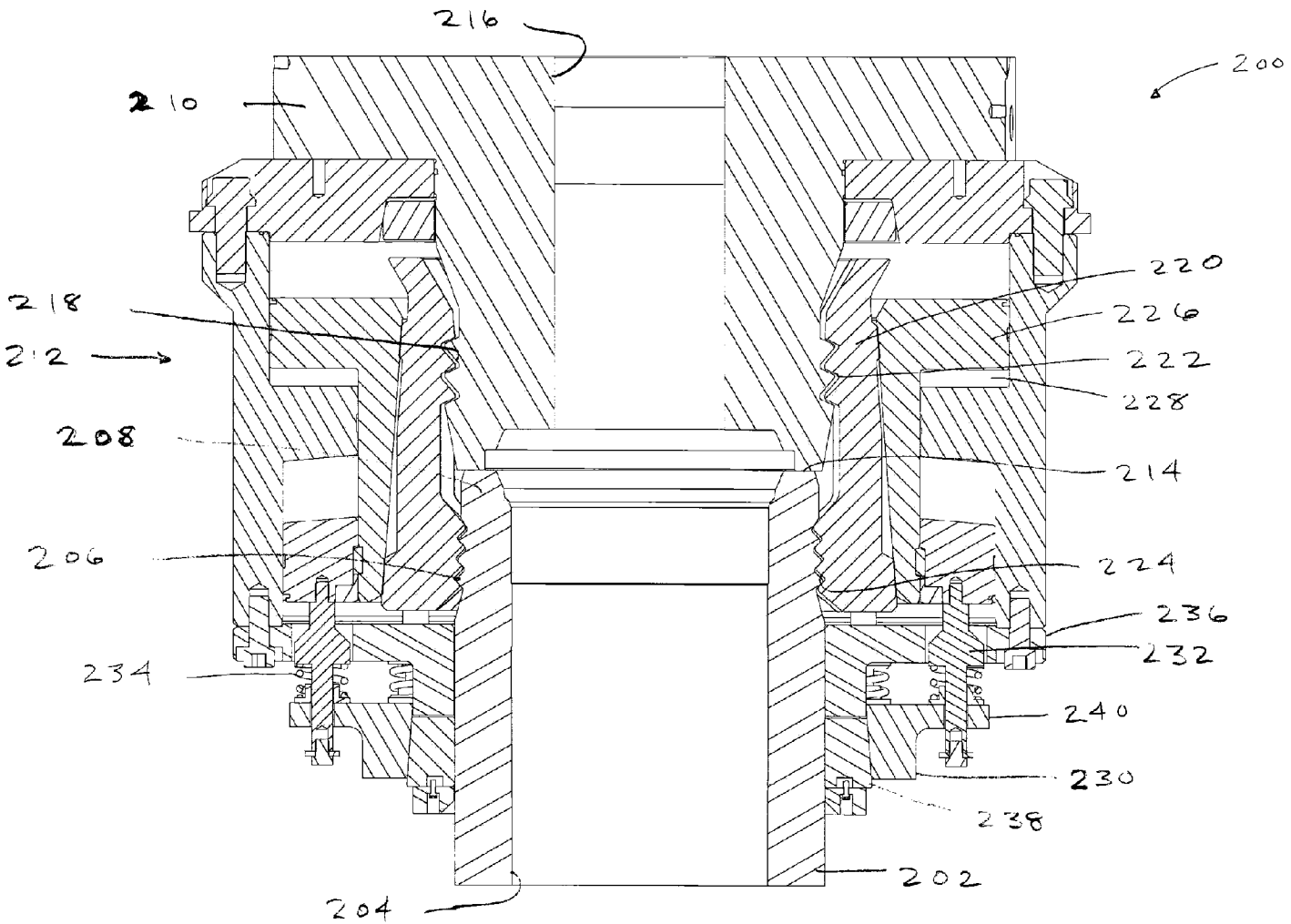
FIG. 3 is cross sectional elevation view of the collet style subsea connector illustrated in FIG. 2 in a locked position.

Subsea connector assembly 212 includes collet connectors 220 which are configured to function as a locking member. Collet connectors 220 include upper and lower grooves 222 and 224, respectively, disposed on the internal profile of the collet connectors 220. Upper grooves 222 correspond to grooves 218 disposed on the outer profile of spool member 210. Lower grooves 224 correspond to grooves 206 disposed on the outer profile of wellhead member 202. Grooves 222 and 224 disposed on the collet connectors 220 are selectively engageable with the corresponding grooves 206 and 218, respectively. That is, grooves 222 and 224 can be moved from a retracted or unlocked position, as illustrated in FIG. 2, to an engaged or locked position, as illustrated in FIG. 3. In the unlocked position, spool member 210 is separable from wellhead member 202. In the locked position, spool member 210 and wellhead member 202 are fixedly coupled.

Grooves 222 and 224 are engaged by a hydraulically actuated tapered piston ring 226 which is slidable through chamber 228. In the alternative, piston ring 226 may be mechanically actuatable. Piston ring 226 is coupled to a tapered lock ring 230 by way of override rod 232. Rod 232 is threadingly engaged with piston ring 226 and axially slidable through chamber 228. Load springs 234, for example, or another apparatus that urges the hydraulically or mechanically actuated piston ring 226 into the locked position, are disposed about rod 232 and are uncompressed when collet connectors 220 are in an unlocked position. The load springs 234 are compressed when collet connectors 220 are in a locked position. The compressed load spring 234 provides positive pressure on the lock ring 230, pressing support dogs 238 against wellhead 202 when in the locked position. The subsea connector assembly 200 further includes a support ring 236 which includes support dog 238. Support dog 238 can be moved from a retracted or unlocked position, as illustrated in FIG. 2, to an engaged or locked position, as illustrated in FIG. 3. During unlock position load shoulder 240 attached to bottom of rod 232 reacts against lock ring 230 to disengage support dogs 238. In operation, the weight of the rings bears down on the dogs and forces the rings down to lock in place; in other words, the natural motion of the connector can be used to assist with the lock and unlock functions.

Referring now to FIGS. 2 and 3, FIG. 2 illustrates the subsea connector assembly 200 in an unlocked position, with the collet connectors 220 and support dog 238 retracted. As discussed above, piston ring 226, when hydraulically or mechanically actuated, moves downward through chamber 228. As piston ring 226, rod 232, and lock ring 230 move downward, the collet connectors 220 move radially inward and grooves 222 and 224 of the subsea connector assembly 200 engage with grooves 218 and 206, respectively. Further, as piston ring 226, rod 232 move downward, and load springs 234 compress, forcing lock ring 230 also downwards, support dog 238 is moved radially inward until it contacts wellhead member 202. The subsea connector assembly 200 is shown in the fully locked position in FIG. 3, with the piston ring 226, rod 232, and support ring 230 having moved downward, causing the collet connectors 220 and support dog 238 to be in engagement with the wellhead member 202. By contacting the wellhead member 202 with the support dog 238, a load path is created below collet connectors 220, which increases the bending capacity of the subsea connector assembly 200 by providing a secondary load path for the applied bending moment.

Figure 4:
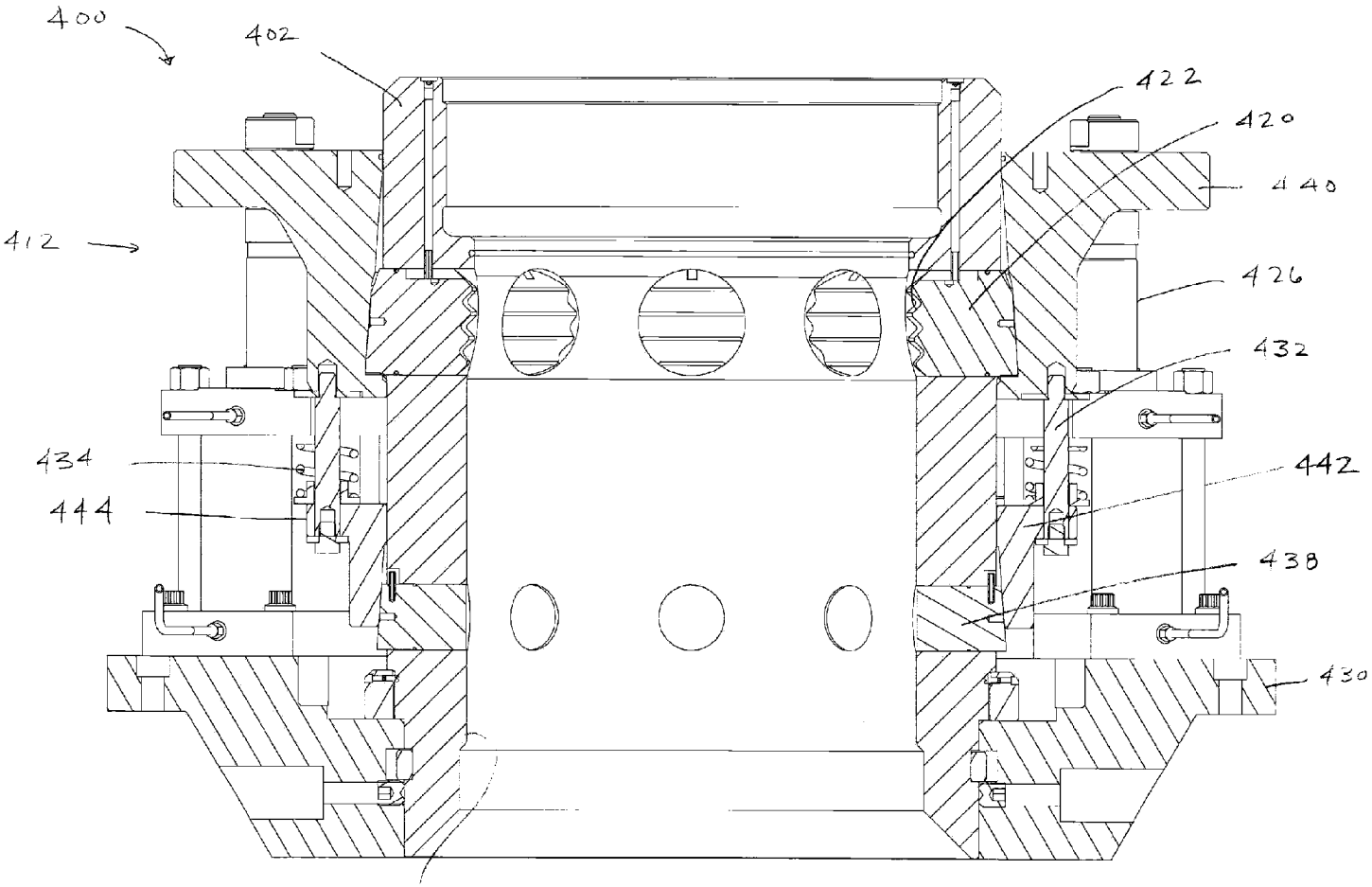
FIG. 4 is cross sectional elevation view of a dog style subsea connector assembly according to one embodiment of the present disclosure in an unlocked position.

Referring to FIG. 4, another embodiment of a subsea connector assembly 400 according to the present disclosure is shown. The dog style subsea connector assembly 412 is configured to couple a spool member to a wellhead member (not shown). Subsea connector assembly 412 includes a main body 402. Subsea connector assembly 412 further includes dogs 420 and support dogs 438, which are configured to function as a locking member. Dogs 420 include grooves 422 on the internal profile of the dogs 420. Grooves 422 of dog 420 correspond to grooves on an outer profile of a wellhead member, such as the wellhead member illustrated in FIGS. 2 and 3. Dogs 420 and support dogs 438 are selectively engageable with an outer profile of a wellhead member, such as the wellhead member illustrated in FIGS. 2 and 3. That is, dogs 420 and support dogs 438 can be moved from a retracted or unlocked position, as illustrated in FIG. 4, to an engaged or locked position, as illustrated in FIG. 5.

Dogs 420 and support dogs 438 are engaged by a hydraulically or mechanically actuated locking cylinder 426. The locking cylinder 426 is configured to move tapered lock ring 440 and tapered support lock ring 442 axially about the subsea connector assembly 400 main body 402. The subsea connector assembly further includes an override rod 432 coupled to the support lock ring 442 with load springs 434 disposed about rod 432. The load springs 434 are uncompressed when dogs 420 and support dogs 438 are in an unlocked position. The load springs 434 are compressed when dogs 420 and support dogs 438 are in a locked position. The compressed load springs 434 provide positive pressure on the lock ring 442 pressing support dogs 438 against wellhead when in the locked position. During unlock position load shoulder 444 attached to bottom of rod 432 reacts against lock ring 442 to disengage support dogs 438.

Figure 5:
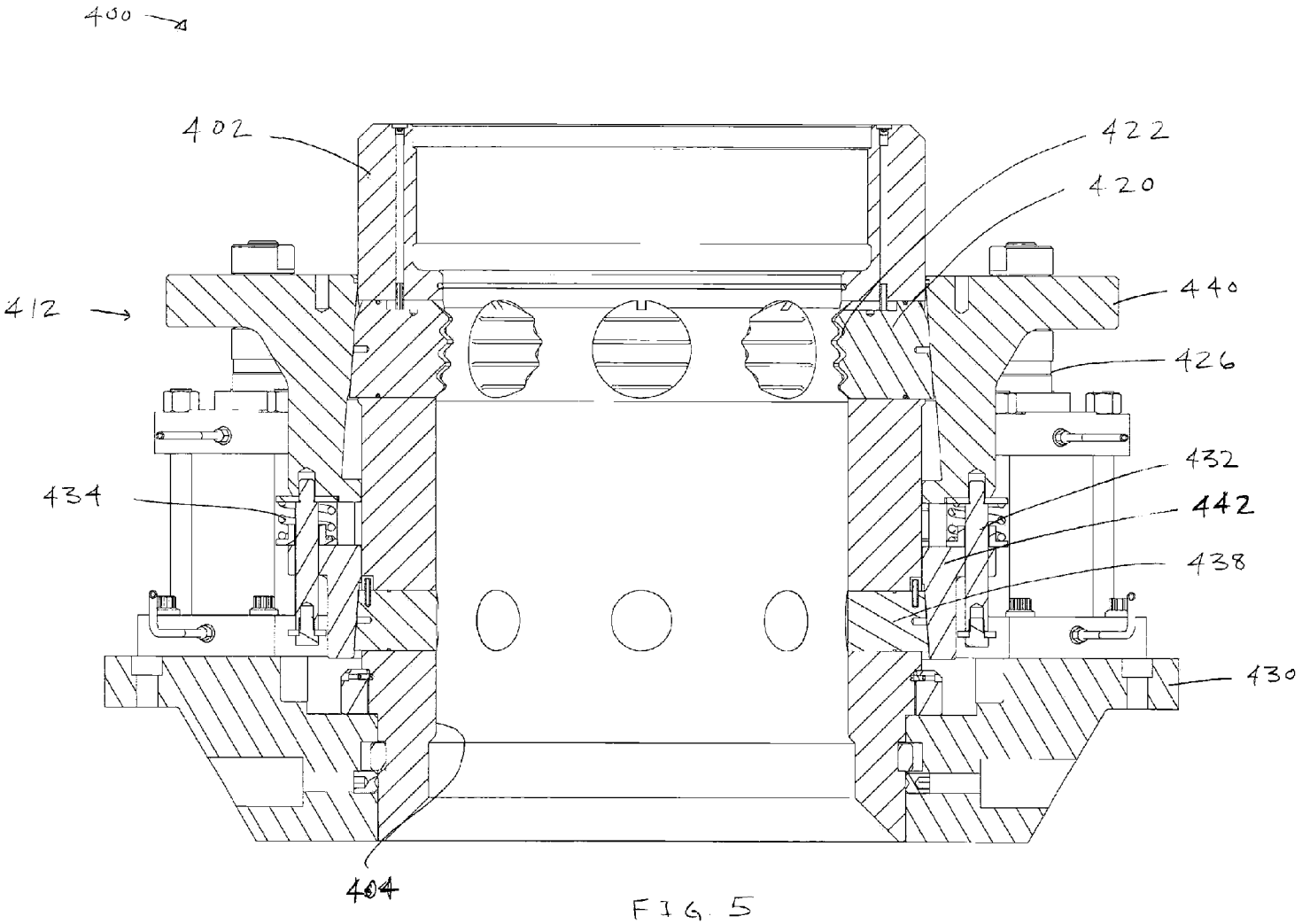
FIG. 5 is cross sectional elevation view of the dog style subsea connector illustrated in FIG. 4 in a locked position.

Referring now to FIGS. 4 and 5, FIG. 4 illustrates the subsea connector assembly 400 in an unlocked position, with dogs 420 and support dog 438 retracted. As discussed above, the locking cylinder, when hydraulically or mechanically actuated, moves locking ring 440 and support lock ring 442 downward relative to the subsea connector assembly 400 main body 402. As lock ring 440 and support lock ring 442 move downward, dogs 420 and support dogs 438 of the subsea connector assembly 200 move radially inward. As dogs 420 and support dogs 438 move radially inward, they are capable of contacting components situated wholly or partially within internal bore 404 of the subsea connector assembly 400. Such a component may be, for instance, a wellhead member coupled to a well. By contacting the wellhead member with the support dogs 438, a load path is created below dogs 420 which increases the bending capacity of the subsea connector assembly 400 by providing a secondary load path for the applied bending moment.

The specific embodiments discussed above relate to coupling a spool member, such as any subsea production, drilling, or completion component, including, but not limited to, a subsea tree, tree system spool, blowout preventer, riser, or the like, to a wellhead member. The disclosed connectors can also be utilized for coupling any two subsea components together, independent of a wellhead. For instance, the disclosed connector could be used to couple a production tree to a production riser, or a lower marine riser package to a drilling riser, or a manifold to a riser, etc. The connector is suitable for any point where components need to be coupled and where increasing bending capacity of the system is beneficial.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A connector apparatus for coupling a subsea component to a subsea member, the subsea component and the subsea member each having an outer profile, the assembly comprising:

a locking member configured to contact and engage the outer profiles of the subsea member and subsea component;

a load support member disposed axially below the locking member and configured to engage the subsea member;

wherein a load path is created when the load support member is engaged with the subsea member; and wherein the locking member is engagable with the subsea member and the subsea component independently of the load support member.

2. The apparatus of claim 1, wherein the locking member and the load support member are movable between a locked position and an unlocked position.

3. The apparatus of claim 2, further comprising an actuatable lock ring assembly axially moveable within the connector apparatus, the lock ring assembly comprising:

a lock ring configured to move the locking member between the locked position and the unlocked position; and a support lock ring configured to move the load support member between the locked position and the unlocked position.

4. The apparatus of claim 3, wherein the lock ring assembly is hydraulically actuatable.

5. The apparatus of claim 3, wherein the lock ring assembly is mechanically actuatable.

6. The apparatus of claim 3, wherein the support lock ring comprises a spring, the spring being uncompressed when the load support member is in the unlocked position, and compressed when the load support member is in the locked position.

7. The apparatus of claim 1, further comprising a plurality of locking members and a plurality of load support members.

8. The apparatus of claim 1, wherein the locking member comprises a collet finger.

9. The apparatus of claim 1, wherein the locking member comprises a dog.

10. The apparatus of claim 1, wherein the locking member comprises a wedge.

11. The apparatus of claim 1, wherein the load support member comprises a dog.

12. The apparatus of claim 1, wherein the load support member comprises a wedge.

13. The apparatus of claim 1, wherein the outer profiles of the subsea member and the subsea component are grooved, and wherein the locking member and the load support member each have an inner profile that is grooved.

14. The apparatus of claim 1, wherein the subsea component is selected from one of a subsea tree, a tree system spool, a blowout preventer stack, and a riser string.

15. A subsea system comprising:

an upper subsea component comprising and outer profile;

a lower subsea component comprising and outer profile; and a connector apparatus for connecting the upper and lower subsea components, the connector apparatus comprising:

a locking member configured to contact and engage the outer profiles of the upper and lower subsea components;

a load support member disposed axially below the locking member and configured to engage the lower subsea component;

wherein a load path is created when the load support member is engaged with the lower subsea component; and wherein the locking member is engageable with the upper and lower subsea components independently of the load member.

16. The system of claim 15, wherein the upper and lower subsea components are selected from one of a subsea tree, a tree system spool, a blowout preventer stack, and a riser string.

17. The system of claim 15, wherein the locking member and the load support member are movable between a locked position and an unlocked position.

18. The system of claim 17, further comprising a hydraulically actuatable lock ring assembly axially moveable within the connector assembly, the lock ring assembly comprising:

a lock ring configured to move the locking member between the locked position and the unlocked position; and a support lock ring configured to move the load support member between the locked position and the unlocked position.

19. The system of claim 15, further comprising a plurality of locking members and a plurality of load support members.

20. The system of claim 15, wherein the locking member comprises a collet finger.

21. The system of claim 15, wherein the locking member comprises a dog.

22. The system of claim 15, wherein the load support member comprises a dog.

23. The system of claim 15, wherein the outer profiles of the upper subsea component and the lower subsea component are grooved, and wherein the locking member and the load support member each have an inner profiles that is grooved.

24. A method for connecting an upper subsea component to a lower subsea component using a subsea connector, the subsea connector including an adjustable locking member and an adjustable load support member located axially beneath the locking member, the method comprising:

disposing the subsea connector at the bottom of the upper subsea component;

landing the subsea connector on the lower subsea component; and actuating one or more piston rings on the subsea connector to move the locking member and the load support member radially inward from an unlocked position to a locked position in which the locking member contacts and engages outer profiles of the upper and lower subsea components and the load support member engages the lower subsea component, thereby creating a load path below the locking member, wherein the one or more piston rings are movable relative to the load support member.

* * * * *